United States Patent [19]

Brunel et al.

[11] Patent Number: 4,669,956

[45] Date of Patent: Jun. 2, 1987

[54] MULTICELLULAR PUMP WITH REMOVABLE CARTRIDGE

[75] Inventors: Roland Brunel, L'Huisserie; Jean-Claude Peu, Laval, both of France

[73] Assignee: Pompes Salmson, Rueil Malmaison, France

[21] Appl. No.: 803,544

[22] Filed: Dec. 2, 1985

[51] Int. Cl.[4] ..... F04D 29/62

[52] U.S. Cl. ..... 415/201; 415/219 C; 417/424

[58] Field of Search ..... 415/201, 206, 219 C, 415/DIG. 3; 417/424

[56] References Cited

U.S. PATENT DOCUMENTS

| | | | |
|---|---|---|---|
| 1,412,281 | 4/1922 | Ghougassof | 415/219 C |
| 2,265,940 | 3/1940 | Forrest | 415/219 R |
| 2,684,033 | 7/1954 | Montgomery et al. | 415/201 X |
| 3,620,642 | 11/1971 | Studebaker et al. | 415/219 C X |
| 3,759,628 | 9/1973 | Kempf | 415/219 C X |
| 3,873,242 | 3/1975 | Anderson | 415/201 X |
| 4,116,583 | 9/1978 | Budris | 415/219 C X |
| 4,588,353 | 5/1986 | Shibata et al. | 415/219 C X |

FOREIGN PATENT DOCUMENTS

| | | | |
|---|---|---|---|
| 832854 | 9/1945 | Fed. Rep. of Germany . | |
| 382927 | 2/1908 | France | 415/219 C |
| 1092549 | 4/1955 | France | 415/201 |
| 390061 | 7/1965 | Switzerland . | |
| 413887 | 7/1934 | United Kingdom . | |
| 2013279 | 8/1979 | United Kingdom . | |

*Primary Examiner*—Robert E. Garrett
*Assistant Examiner*—Joseph M. Pitko
*Attorney, Agent, or Firm*—Marmorek, Guttman & Rubenstein

[57] ABSTRACT

The invention concerns a pump, especially of the multicellular vertical type, in which the hydraulic and mechanical elements are contained within a cartridge that allows an overall intervention upon the pump in order to change the said mechanical and hydraulic elements.

5 Claims, 1 Drawing Figure

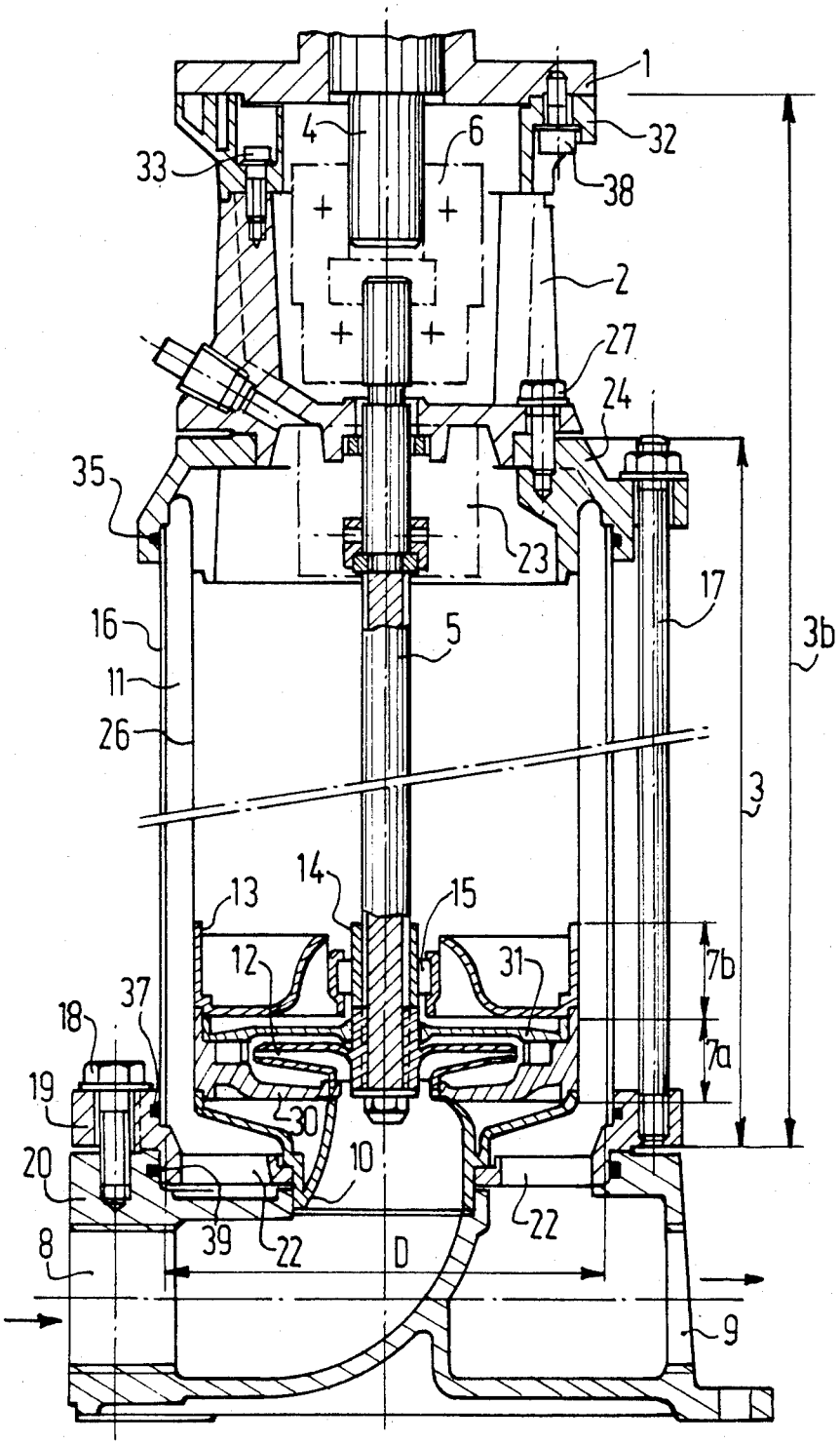
1
32
4
6
33
38
2
27
24
35
23
17
16
5
3b
11
26
3
14
13
15
12
31
7b
37
18
7a
19
30
10
20
39
22
22
8
D
9

MULTICELLULAR PUMP WITH REMOVABLE CARTRIDGE

BACKGROUND OF THE INVENTION

1. Field of the Invention

The present invention concerns a multicellular pump of which the hydraulic and mechanical elements are mounted within a removable cartridge.

2. Description of the Prior Art

According to the prior art, it is known to build pumps comprising a stacking of pumping cells. Upon a common pump shaft, several cells comprising hydraulic and mechanical elements are stacked upon one another successively. The whole is connected to a driving shaft through a coupling device. In the event of break-down or in the case of modification to the pumping characteristics, it is necessary to dismantle, upon the installation on site, each of the elements of the pump to be replaced. Repairing time is long, costly and shuts down the installation, thereby preventing pumping over what can be a considerable period. In order to overcome the drawbacks of the prior art, the present invention concerns a multicellular pump, wherein the hydraulic and mechanical elements of the pump are contained within a removable cartridge, on the one hand, on the side of the driving shaft and, on the other hand, on the side of the circuit of the fluid to be pumped.

BRIEF DESCRIPTION OF THE DRAWINGS

Other features, advantages and objects of the present invention will become apparent from reading the following description, given by way of non-limitative illustration to the appended single drawing.

The drawing represents a vertical multicellular pump of the centrifugal type comprising mainly a motor 1 coupled by means of a device 2 to a hydraulic assembly 3. The pump is mounted upon a fluid circuit to be pumped and mainly comprising an inlet pipe 8 and a discharge pipe 9. The motor shaft 4 is connected by means of a coupling device 6 to the shaft 5 of the pump itself.

The hydraulic and mechanical elements are contained within several successive stages stacked along the length of the pump shaft 5.

The term "hydraulic element" as used herein means at least one cell like that *7a* represented in the drawing. It comprises a centrifugal rotor 12 and a static part formed from the diffuser and the channels 31. The term "mechanical element" as used herein means, for example, the cell *7b* that comprises a support 13 and a journal for guiding shaft 5, consisting of a liner 14 and a bearing 15 integral with the support 13. It is mainly these hydraulic and mechanical elements that are subject to wear or deterioration due to the working conditions that can bring about damage, disturbances or shutdowns.

According to the prior art, a complete dismantling operation of the pump was required in order to proceed with its repair and overhaul.

According to the invention, the cartridge 3 is mainly constituted from:

the shaft 5 fitted with a sealing device 23;

a lower end flange 19, called closing piece, an upper end flange 24.

The whole is formed as a single piece assembly through a plurality of stay bolts 17 that secure the lower flange 19 to the remainder of the cartridge. In this example, the stay bolt 17 connects the two lower pieces. But, the cartridge can also have the shape of a cartridge designated *3b*, formed of cartridge 3 to which is added a hood 2 that allows to reach the sealing device 23. It is also possible to associate thereto a centering sleeve 32 of the cartridge *3b* on the motor 1.

The pump-hood 2 is connected to the upper flange 24 through screws 27 and the centering sleeve 32 to the hood 2 through screws 33. The cartridge *3b* is thus mounted upon the motor 1 by screws 38.

This design allows, in particular, overall interventions to be made upon the pump outside the motor. Therefore, any pump change or replacement can be performed by a non-specialized operator during a single operation on site which consists of a very simple technique and only lasts a short time, thereby reducing the costs of shut-down of the pump. Accordingly, intervention costs are reduced. The assembly within a single overall cartridge (which can be stored) of the hydraulic and mechanical elements allows to avoid the necessity of having an entire stand-by generator ready in reserve. It is henceforth no longer necessary to manage a large number of spare parts, as was the case according to the prior art. It is also possible to adapt for the situation each application by a simple change of the cartridge on site. Thus, the pulse devices and the steady parts can be produced, for example, either in synthetic material or in stainless steel. The pumping characteristics change according to the material and the shape of the hydraulic and mechanical elements.

In order to ensure the sealing of the cartridge, said cartridge comprises sealing rings disposed on either side between the flange 19 and the cartridge body 16. The sealing device 23 prevents the rise of the pumping fluid along the length of the shaft towards the coupling device. In a preferred embodiment, the pump is mounted upon a pump body of the "in line" type in which the inlet and discharge orifices 8 and 9 are in line and at the same level. The inlet pipe 8 of the pump body communicates with an inlet flange 10 connected, at the base of the shaft 5, with the first hydraulic element *7a*. The pumped liquid is drawn in and rises along the length of the shaft 5 within the succession of stacked cells in order to finally fall back into an annular duct 11 disposed between the external shell 16 of the cartridge and the cylindrical surface 26 constituted by the stacking of the cells. The pumping liquid penetrates within an annular exhaust chamber 22 that communicates with the discharge pipe 9. The attachment between the flange 19 and the pump body 20 is achieved through several bolts 18.

For the servicing of the multicellular pump according to the invention, it is necessary during a first operation to release the coupling device 6 which connects the shaft 5 to the motor shaft 4. Then, in a second operation, in the event where the cartridge is of type *3b*, the attachments between sleeve 32 and motor 1 are released through dismantling screw 33 and between lower flange 19 and pump body 20 by dismantling screws 18. Through simple raising of block made of motor 1 coupling device 6, it is thus possible to disengage the cartridge *3b* which can at any moment be sent back for usual repairs or for a simple cartridge replacement.

The present invention can be adapted to different forms of pumps and especially to centrifugal pumps admitting that inlet and discharge orifices be placed at different levels of the pumps. In this case, the discharge orifice 9 is transferred from the pump body 20 to the upper flange 24. This orifice will directly communicate with the outlet of this last pumping cell. The annular chamber or duct 11 and the external shell 16 are thereby suppressed.

It will be noted on the FIGURE that the flange 19 and the pump body 20 can be designed in order to receive a pumping assembly that is or is not in a cartridge. This disposition can be advantageous in the case of low-price installations or in the case where the constitution of a pumping assembly in cartridge would be too expensive. In fact, the FIGURE shows that the flange 19 comprises a recess intended to receive the cartridge 3 which has the same diameter D as the recess of the pump body 20 that carries the bearing. Furthermore, the sealing rings 39 and 37 have the same dimensions. Therefore, in the absence of a lower flange 19 it is possible to adapt the pumping assembly upon the pump body 20. In this case there is not a cartridge design but this characteristics allows,the standardization of the manufacture of multicellular pumps whether or not in cartridge.

On the other hand, the attachment of the pumping assembly can be ensured without screws 18 in the absence of the flange 19. In fact, it is sufficient to rotate the pumping assembly by a determined angle in order that the stay bolts 17 can be screwed directly in place of screws 18 since the number, the dimensions and the inter-axes of the stay bolts are identical to those of the screws 18.

Furthermore, it will be noted that this characteristic can easily be extended to all multicellular pumps, even those of which the inlet and discharge orifices are not at the same level.

We claim:

1. A multicellular centrifugal pump, comprising a motor, said motor including a motor shaft, a pump body containing a fluid circuit, said circuit including an inlet orifice and an outlet orifice, and a pump assembly disposed between said motor and said pump body, said pump assembly driven by said motor, said pump assembly receiving a fluid to be pumped from said inlet orifice and discharging said fluid to said out orifice, said pump assembly comprising a pump shaft connected to said motor shaft, a series of hydraulic and mechanical pumping elements disposed said pump shaft, an external shell enclosing said hydraulic and mechanical pumping elements, an annular duct being formed between said external shell and said hydraulic and mechanical pumping elements, an upper end flange at one end of said pump assembly, a lower end flange at the other of said pump assembly, said lower end flange being connected to said pump body by a first set of attachment means, sealing means in the region of said upper end flange, releasable coupling means connecting said pump shaft to said motor shaft, a centering sleeve disposed between said motor and said upper end flange, said centering sleeve being connected to said motor by a second set of attachment means, a hood disposed between said upper end flange and said centering sleeve, said hood being connected to said upper end flange by a third set of attachment means, and connecting means connecting said upper end flange to said lower end flange and holding said pump assembly together as a unit, wherein said pump assembly is formed as a cartridge removable as a unit.

2. The multicellular pump of claim 1 further comprising second sealing means disposed between said external shell and said upper and lower end flanges.

3. The multicellular pump of claim 1 wherein said connecting means comprises stay bolts.

4. The multicellular pump of claim 1, wherein said first, second and third attachment means are threaded.

5. The multicellular pump of claim 1 wherein said connecting means comprises said first set of attachment means.

* * * * *